US007538753B2

(12) United States Patent
Tanada

(10) Patent No.: US 7,538,753 B2
(45) Date of Patent: May 26, 2009

(54) DISPLAY DEVICE AND ELECTRONIC APPARATUS

(75) Inventor: Yoshifumi Tanada, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 477 days.

(21) Appl. No.: 10/739,154

(22) Filed: Dec. 19, 2003

(65) Prior Publication Data

US 2004/0130542 A1 Jul. 8, 2004

(30) Foreign Application Priority Data

Dec. 25, 2002 (JP) ..... 2002-373570

(51) Int. Cl.
*G09G 3/36* (2006.01)

(52) U.S. Cl. ..... 345/100; 345/98

(58) Field of Classification Search ..... 345/98–100, 345/86–89, 55, 204; 377/64
See application file for complete search history.

(56) References Cited

U.S. PATENT DOCUMENTS

| | | | | |
|---|---|---|---|---|
| 4,990,902 | A * | 2/1991 | Zenda | 345/698 |
| 5,406,308 | A * | 4/1995 | Shiki | 345/99 |
| 5,534,884 | A | 7/1996 | Mase et al. | |
| 5,708,455 | A * | 1/1998 | Maekawa | 345/100 |
| 5,781,171 | A | 7/1998 | Kihara et al. | |
| 5,781,185 | A * | 7/1998 | Shin | 345/213 |
| 5,877,740 | A | 3/1999 | Hirakata et al. | |
| 5,926,159 | A * | 7/1999 | Matsuzaki et al. | 345/97 |
| 6,011,535 | A | 1/2000 | Katoh et al. | |
| 6,232,945 | B1 * | 5/2001 | Moriyama et al. | 345/98 |
| 6,310,600 | B1 | 10/2001 | Koyama et al. | |
| 6,320,567 | B1 | 11/2001 | Hirakata et al. | |
| 6,448,954 | B1 | 9/2002 | Katoh et al. | |
| 6,741,231 | B2 | 5/2004 | Katoh et al. | |
| 2001/0033278 | A1 * | 10/2001 | Ohta et al. | 345/204 |
| 2002/0075249 | A1 | 6/2002 | Kubota et al. | |
| 2002/0135556 | A1 * | 9/2002 | Nakajima et al. | 345/98 |
| 2002/0196243 | A1 * | 12/2002 | Morita | 345/204 |

FOREIGN PATENT DOCUMENTS

| | | |
|---|---|---|
| JP | 2002-32048 | 1/2002 |

* cited by examiner

*Primary Examiner*—Regina Liang
(74) *Attorney, Agent, or Firm*—Eric J. Robinson; Robinson Intellectual Property Law Office, P.C.

(57) ABSTRACT

A display device enabling a superimpose display in which an image is superimposed on a background image with low power consumption is provided. By providing a switch at an input terminal of each stage of a scanning circuit which has a plurality of stages for outputting a sampling pulse or a row selection pulse, and by selecting whether or not to permit an input of a start pulse or each output pulse of a prior stage by the switch, it becomes possible to input a start pulse to an arbitrary mid-stage and output a sampling pulse or a row selection pulse from the stage. Accordingly, the pulse is outputted only to a region where a video signal needs to be updated in a display screen, and a row and a column are selected, thus a new video signal is written thereto.

21 Claims, 13 Drawing Sheets

PRIOR ART

PRIOR ART

DISPLAY DEVICE AND ELECTRONIC APPARATUS

BACKGROUND OF THE INVENTION

1. Field of the Invention

The present invention relates to a display device and a driving method of the same and, more particularly, to a display device which has added value such as a partial display, a superimpose function, and the like.

2. Description of the Related Art

In recent years, a display device using a self-light emitting element represented by an electro luminescence (EL) element and the like has been studied and developed as a flat panel display device in place of a liquid crystal display (LCD) having pixels which use liquid crystal elements. The display device using the self-light emitting element has advantages in that it achieves high image quality and a wide view angle, and has a thin form, light weight, and the like since a backlight is not required. By making use of these advantages, the light emitting device using the self-light emitting element is expected to be widely used as a display screen of the portable telephone or the display device.

Further, concerning the portable telephone and the like, high added value is required as a result of the diversification of its intended use. Recently, the portable telephone having a superimpose function which is capable of displaying a text, or an image and the like so as to be superimposed partially on a display screen has been provided (Reference 1: Japanese Patent Application Laid-open No. 2002-32048). By means of the superimpose function, higher quality of display, sufficient communication performance, and further a solid user interface can be provided.

SUMMARY OF THE INVENTION

When an image or a text is to be displayed on a part of a region where another image is displayed as shown in FIGS. 3A and 3B for example, it is recognized by a user that a part of a background image 301, namely a region of a superimpose image 302 only is updated, and a region where the original image is displayed, namely the rest of the background image 301 remains as it is. However, the entire screen including the region which does not seem to be updated is, actually, updated.

Specifically, as shown in FIG. 3A, there are some states where no superimposition is performed on the display screen in the m-th row and the n-th column at the k-th frame. When the superimpose image 302 is added onto the region surrounded by the a-th to b-th columns and the c-th to d-th rows at the (k+1)-th frame, the updating is performed actually over an entire screen at the (k+1)-th frame as shown in FIG. 3C. That is, during one frame period 310, m rows are selected and in each of the rows, n dots are sampled.

This is because, a conventional scanning circuit represented by a shift register and the like employs a configuration as shown in FIG. 2A in general, and pulses are sequentially outputted from the first stage in accordance with a start pulse (SP), clock signals (CK·CKb), and the like as shown in FIG. 2B.

Meanwhile, a display device may have a driver circuit for superimpose images which is independent of the one for normal image displays as described in reference 1. However, in either configuration, it is necessary that an entire display region is scanned so as to update a part of the screen only. It is therefore expected that, by realizing the updating of the region to be superimposed only, short-period operation of the driver circuits can be achieved, or an operation frequency can be set low. However, the display device having such a function has not been provided so far.

The invention is made in view of the foregoing problems, and has an object thereof to provide a display device which enables a superimpose processing at low power consumption without enlarging the size of a driver circuit.

As described above, in the conventional scanning circuit, a row and a column are selected by sequentially outputting pulses (sampling pulses from a source driver circuit, and row selection pulses from a gate driver circuit) as shown in FIG. 2B from one end up to the other end of the scanning circuit comprising a plurality of stages of D-flip-flops (FF) 201 in accordance with control signals (here, CK·CKb and SP) in general as shown in FIG. 2A.

According to the invention, an output of a pulse in the scanning circuit can be started from an arbitrary stage, and ended also at an arbitrary stage, thus a subsequent stage is not to be scanned. Accordingly, even when only a part of a display screen is scanned, only a specified region can be selectively scanned, thus an image signal can be written into a pixel with enough time. That is, an operation frequency can be suppressed low.

A display device according to the invention comprises a pixel portion where pixels are arranged in matrix of m rows by n columns; a source driver circuit; and a gate driver circuit which control the pixel portion, wherein the source driver circuit comprises a first scanning circuit which outputs at least n stages of sampling pulses; the first scanning circuit includes a first operation mode in which sampling pulses are sequentially outputted from the first stage up to the n-th stage, and a second operation mode in which sampling pulses are sequentially outputted from the a-th (a is a natural number and $1<a\leqq n$) stage up to the b-th (b is a natural number and $a\leqq b\leqq n$) stage; the gate driver circuit comprises a second scanning circuit which outputs at least m stages of row selection pulses; the second scanning circuit includes a first operation mode in which row selection pulses are sequentially outputted from the first stage up to the m-th stage, and a second operation mode in which row selection pulses are sequentially outputted from the c-th (c is a natural number and $1<c\leqq m$) stage up to the d-th (d is a natural number and $c\leqq d\leqq m$) stage.

A display device according to the invention, wherein the first scanning circuit comprises a first switch provided at an input terminal of the first stage, and a second switch provided at an input terminal of the k-th (k is a natural number and $1<k\leqq n$) stage; the first switch selects whether to permit an input of a start pulse or not; the second switch selects whether to permit an input of the start pulse or each output pulse of the (k−1)-th stage, or prohibits either of them; the second scanning circuit comprises a first switch provided at an input terminal of the first stage, and a second switch provided at an input terminal of the j-th (j is a natural number and $1<j\leqq m$) stage; the first switch selects whether to permit an input of a start pulse or not; and the second switch selects whether to permit an input of the start pulse or each output pulse of the (j−1)-th stage, or prohibits either of them.

By the above configuration, when a superimpose image is to be displayed on a background image, only a signal in a specified region can be updated without scanning a region of the background image whose signal does not need to be updated.

It is to be noted that, according to the invention, high-performance display devices can be provided for a variety of electronic apparatuses such as a display device, a personal computer, a mobile information terminal such as a personal digital assistant (PDA) and a mobile telephone, and a digital camera.

According to the invention, a display device having a superimpose function with high added value and low power consumption can be realized by efficiently updating its display screen. In particular, when applying the invention to a mobile information terminal and the like which mainly displays a still image, high performance thereof can be provided by the low power consumption without wasting battery power during the battery driving time.

DETAILED DESCRIPTION OF THE PREFERRED EMBODIMENTS

Preferred Embodiments of the invention will be hereinafter described referring to the accompanying drawings.

Embodiment Mode 1

Figure 1A:
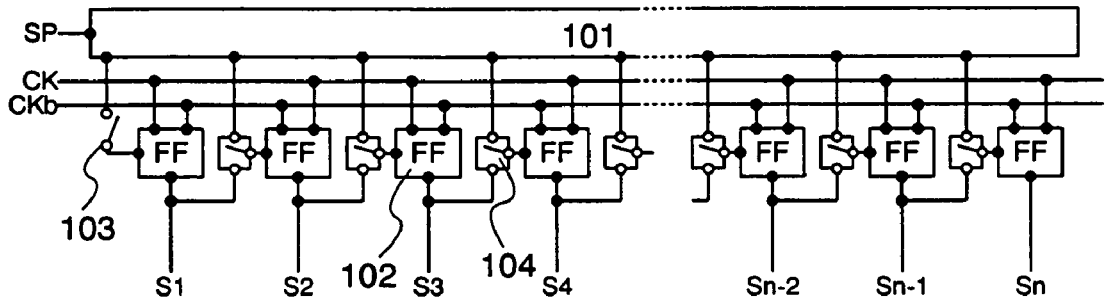
FIGS. 1A to 1C are diagrams showing an embodiment mode of the invention.

FIG. 1A shows a configuration of a scanning circuit as an embodiment mode of the invention. The scanning circuit has the same configuration as a conventional one in the respect that it employs a plurality of stages of D-flip-flops 102. However, it is additionally provided with a switch 104 for selecting an SP input/an prior stage input (hereinafter merely referred to as a switch 104) between each of the adjacent stages. Also, at an input terminal of the first stage, a switch 103 for selecting an SP input (hereinafter merely referred to as a switch 103) is provided.

The switch 103 provided at the input terminal of the D-flip-flop 102 of the first stage selects whether to permit an input of a start pulse (SP) to the first stage or not. The switch 104 provided between each of the adjacent stages of the D-flip-flops 102 selects whether to permit an input of SP or an output from the D-flip-flop 102 of a prior stage as an input to the D-flip-flop 102 of a subsequent stage, or selects neither of them.

The switches 103 and 104 are controlled, for example, by an address decoder 101 as shown in FIG. 1A. However, the configuration is not limited to this.

Figure 4A:
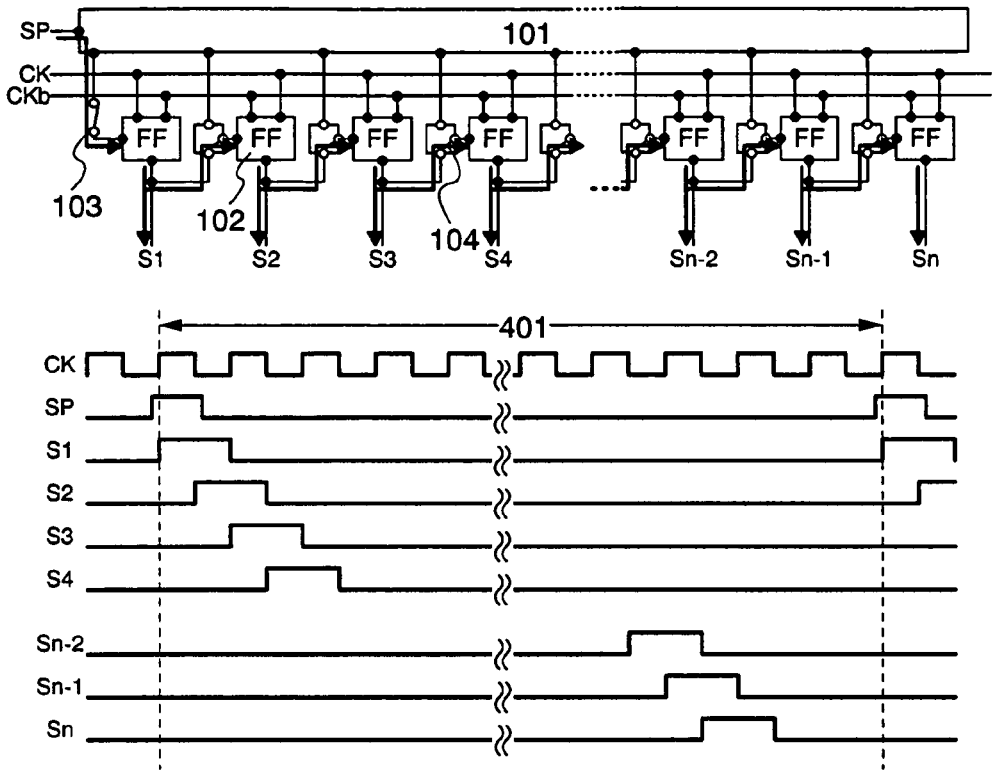
FIGS. 4A and 4B are diagrams showing operation timing of an embodiment mode of the invention.
Figure 4B:
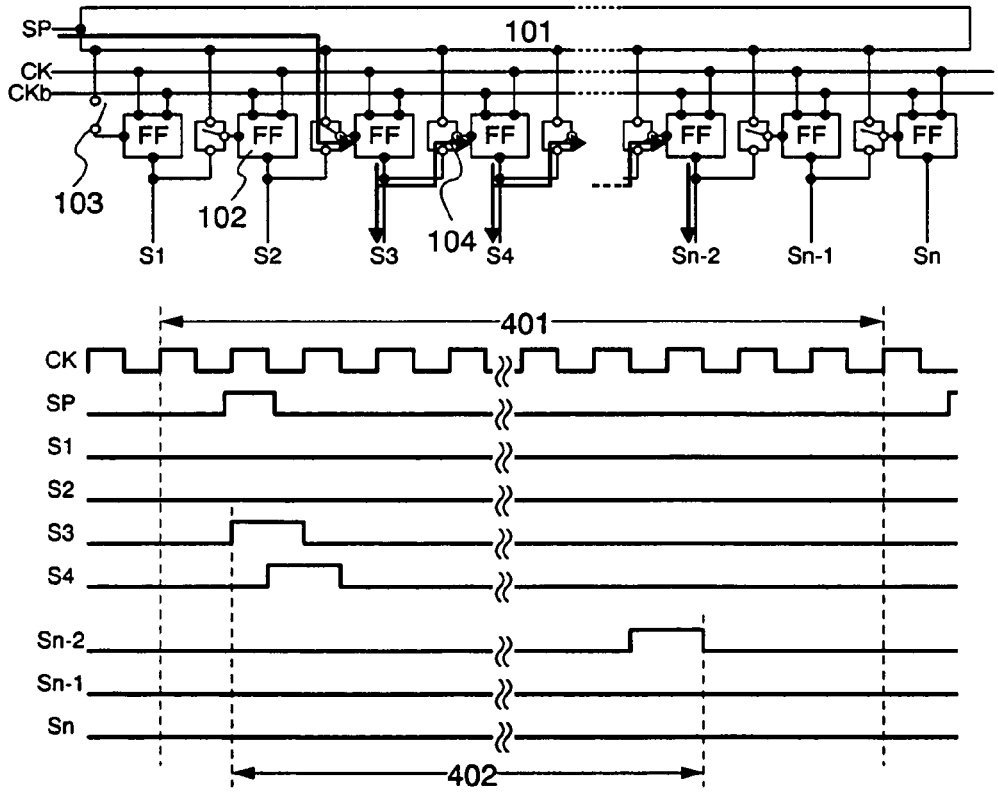
Figure 5A:
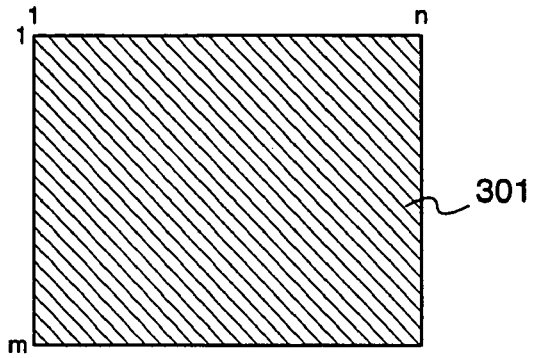
FIGS. 5A to 5C are diagrams for explaining a sampling operation of the invention when a superimpose image is added onto a background image.
Figure 5B:
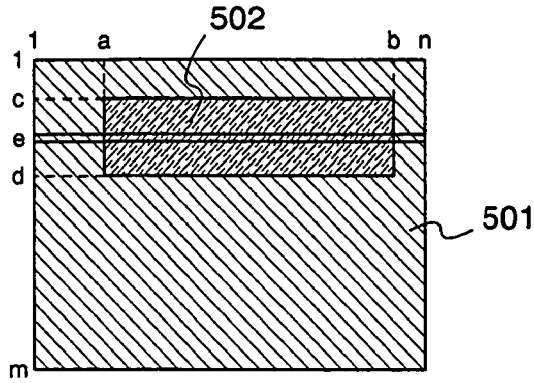
Figure 5C:
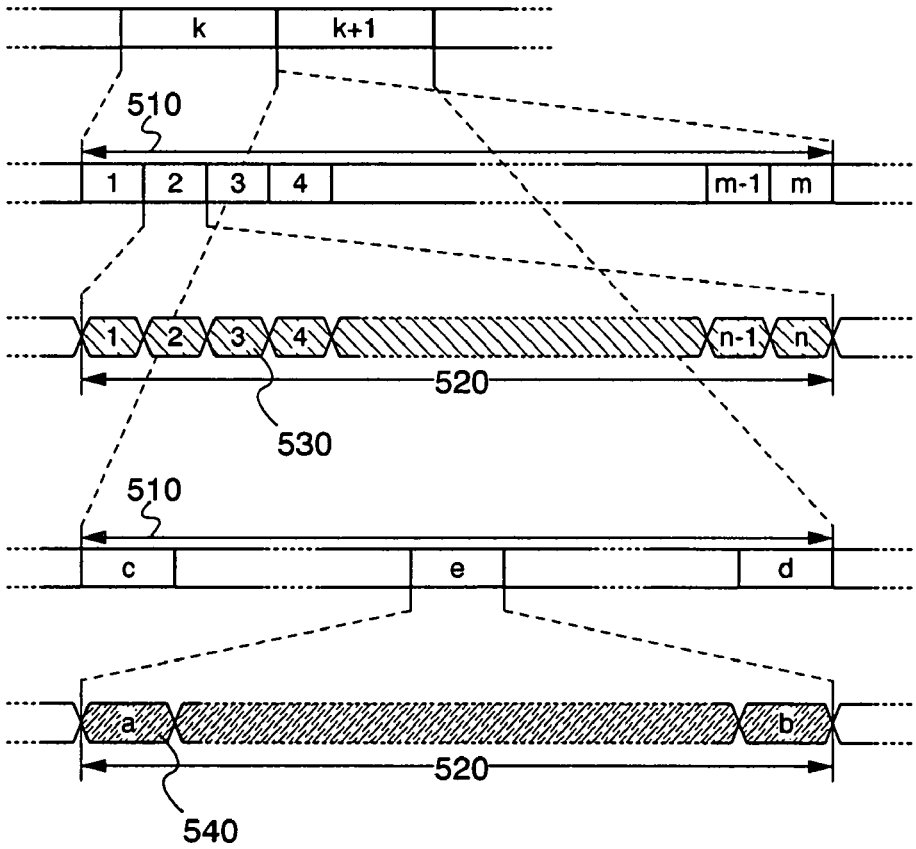

Next, operation of the scanning circuit is described below with reference to FIGS. 4A and 4B.

Firstly, operation which is the same as a normal one is explained with reference to FIG. 4A. Once the switch 103 only is turned ON, thereby permitting an input of SP to the D-flip-flop 102 of the first stage, each of the switches 104 provided at the second stage or latter becomes in a state of taking in an output from its prior stage. The selection of the stage to which SP is inputted and the control of the switches 103 and 104 are carried out, for example, by the address decoder 101 and the like.

In this state, SP is inputted to the first stage, and then pulses are sequentially outputted from the first stage up to the final stage in accordance with CK and CKb. In FIG. 4A, a period denoted by 401 corresponds to one horizontal period (one frame period in the gate driver circuit).

Next, operation when only a specified region is selectively scanned is described with reference to FIG. 4B. In this example, a region from the third stage to the (n−2)-th stage is to be selectively scanned. In this case, the switch 103 is turned OFF, and the D-flip-flop 102 of the first stage becomes in a state in which no SP is inputted. Also, as for the D-flip-flop 102 of the second stage or latter, the switch 104 which provided at each input terminal of the D-flip-flops 102 of the stages which are not to be scanned, namely of the second, (n−1)-th, and n-th stages becomes in a state of taking in neither outputs of their prior stages nor SP. The switch 104 provided at an input terminal of the D-flip-flop 102 of the third stage becomes in a state of taking in SP, and the switch 104 each provided at the D-flip-flops 102 from the fourth stage to the (n−2)-th stage becomes in a stage of taking in outputs from their prior stages. The selection of the stage to which SP is inputted and the control of the switches 103 and 104 are carried out by the address decoder 101.

In this state, SP is inputted to the third stage, and then pulses are sequentially outputted from the third stage up to the (n−2)-th stage in accordance with CK and CKb. Then, from the subsequent stage, namely on the (n−1)-th and n-th stages, there is no pulse outputted since the switches 104 prohibit the input from their prior stages. In FIG. 4B, a period denoted by 401 corresponds to one horizontal period (one frame period in the gate driver circuit). Specifically, a period denoted by 402 corresponds to a period during which a pulse is actually outputted.

As described above, redundant data does not need to be sampled since a scanning pulse is not outputted in the region where a signal does not have to be updated. That is, it becomes possible to scan only a specified region selectively within one horizontal period (or one frame period). The operation performed during the period denoted by 402 may be completed within the period denoted by 401, therefore, an operation frequency can be suppressed while extending a sampling period.

Figure 1B:
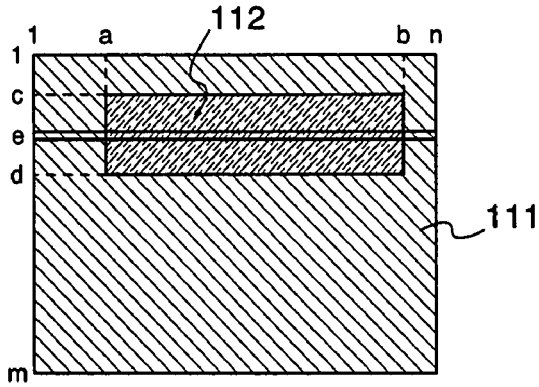
Figure 1C:
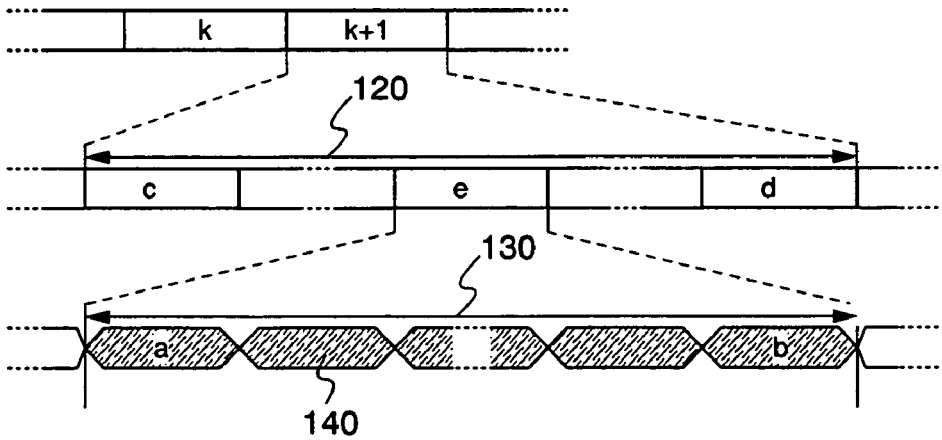
Figure 2A:
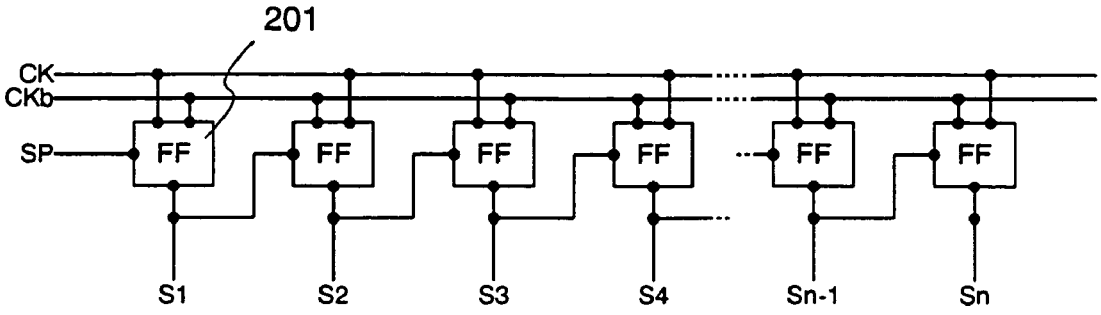
FIGS. 2A and 2B are diagrams showing a configuration of a conventional shift register and its operation timing respectively.
Figure 2B:
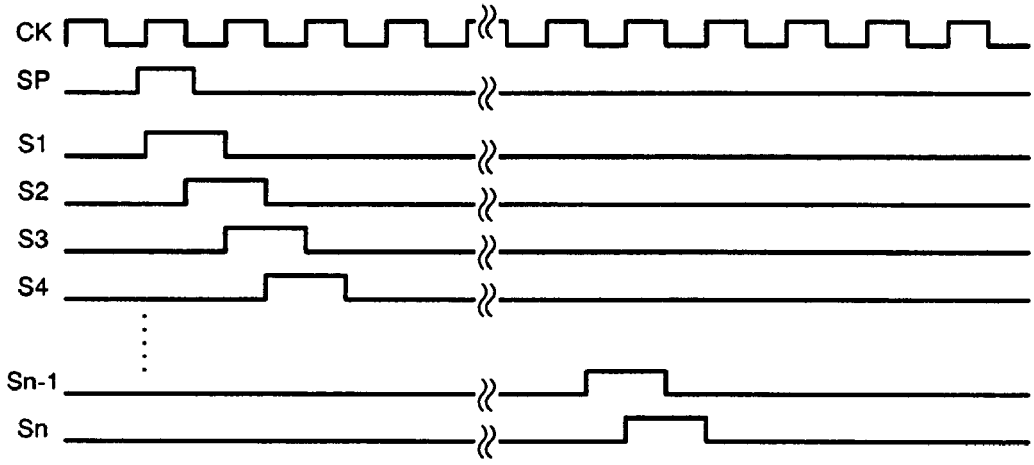
PRIOR ART FIG.2B
Figure 3A:
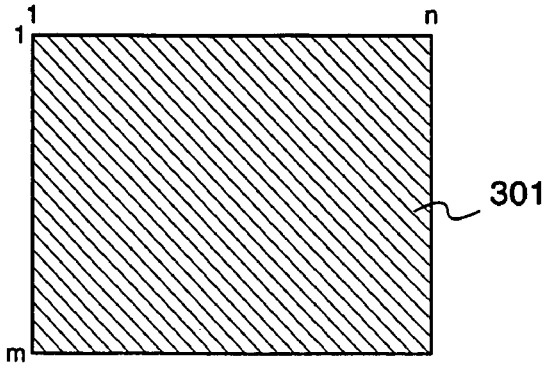
FIGS. 3A to 3C are diagrams for explaining a conventional sampling operation when a superimpose image is added onto a background image.
Figure 3B:
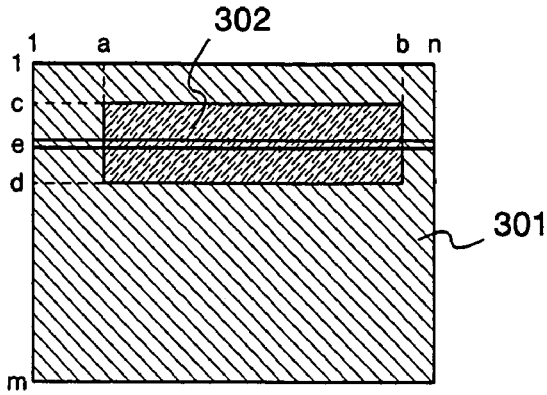
PRIOR ART FIG.3B
Figure 3C:
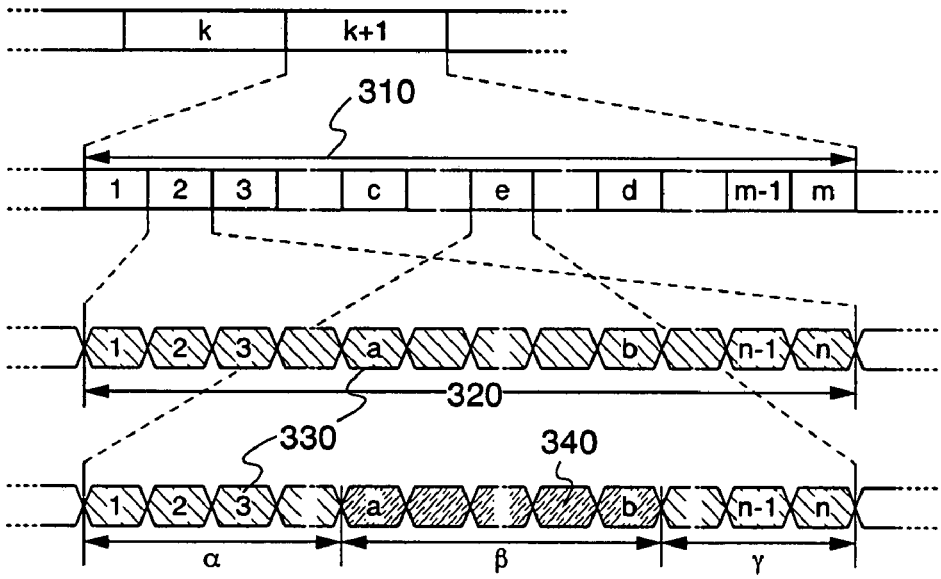
PRIOR ART FIG.3C

That is, as shown in FIG. 1B, when the superimpose image 112 is displayed on the background image 111, or specifically, when the background image 111 is displayed until the k-th frame, and the superimpose image 112 is displayed at the (k+1)-th frame, the region where video signals are updated from the k-th frame to the (k+1)-th frame corresponds to a region surrounded by the a-th to b-th columns and the c-th to b-th rows. Therefore, according to the invention, only the c-th to d-th rows are scanned at the (k+1)-th frame, and during each period, video signals are sampled only in the a-th to b-th columns as shown in FIG. 1C.

Described above with reference to FIG. 4B is an explanation only on the operation timing of a source side. The same method can be adopted for a gate side by selectively scanning the c-th to d-th rows only.

By the above operation, a circuit operation with a sufficient time and low power consumption thereof can be realized.

Embodiment Mode 2

When a superimpose image overlaps with a background image, there is a case where the superimpose image is displayed simultaneously across a plurality of regions. In this embodiment mode, a driving method of a scanning circuit in this case is explained.

Figure 6A:
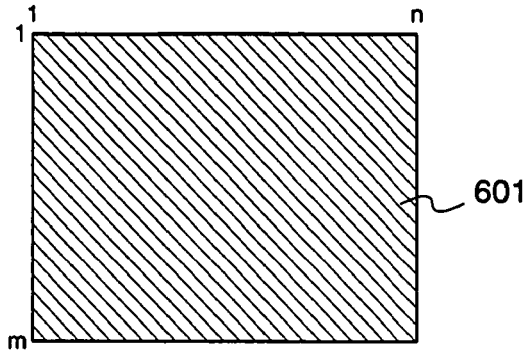
FIGS. 6A to 6C are diagrams for explaining of a sampling operation of the invention when a superimpose image is added onto a background image.
Figure 6B:
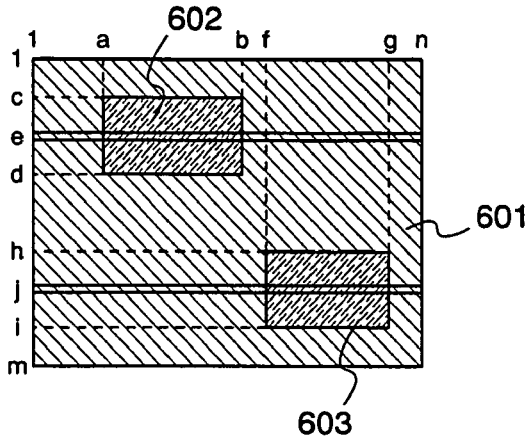

As shown in FIGS. 6A and 6B, supposed here is the case where superimpose images 602 and 603 are displayed on a background image 601. The superimpose image 602 corresponds to a region surrounded by the a-th to b-th columns and the c-th to d-th rows, and the superimpose image 603 corresponds to a region surrounded by the f-th to g-th columns and the h-th to i-th rows.

When the background image 601 only is displayed at the k-th frame, and the superimpose images 602 and 603 are displayed at the (k+1)-th frame, video signals are updated in the region surrounded by the a-th to b-th columns and the c-th to d-th rows and in the region surrounded by the f-th to g-th columns and the h-th to i-th rows.

Figure 6C:
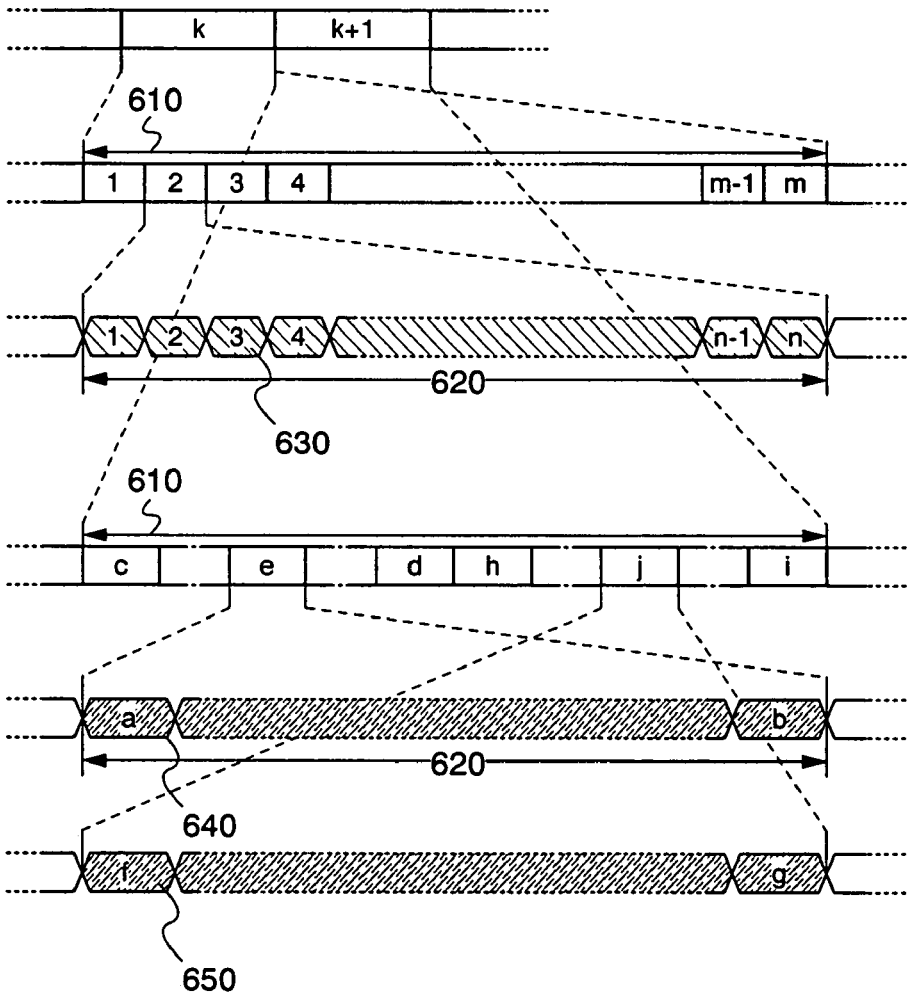

According to the invention, the c-th to d-th rows only are scanned at the (k+1)-th frame first, and during each period, video signals are sampled only in the a-th to b-th columns as shown in FIG. 6C. Subsequently, the h-th to i-th rows are scanned during each period, and video signals are sampled only in the f-th to g-th columns.

Specific operation of the scanning circuit is explained below with reference to FIGS. 7A and 7B.

Figure 7A:
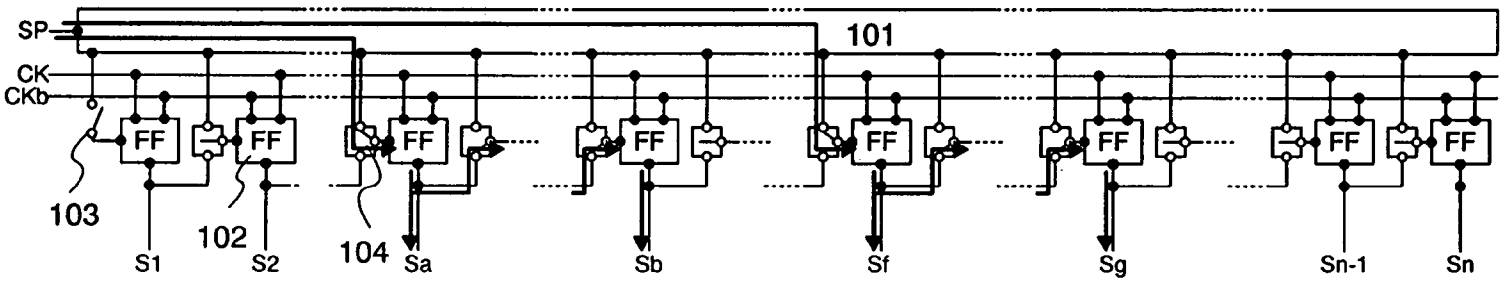
FIGS. 7A and 7B are diagrams showing operation timing according to an embodiment mode of the invention.
Figure 7B:
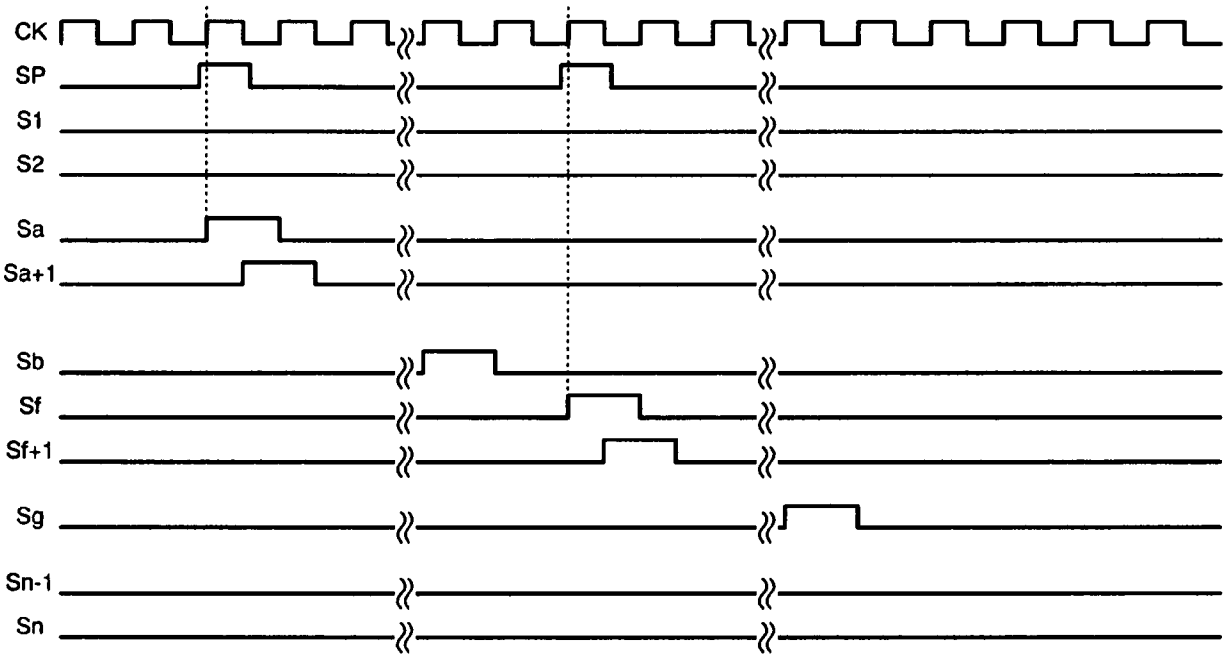

As described in Embodiment Mode 1, an input of SP is controlled by the switches 103 and 104 each provided at input terminals of the D-flip-flops 102 as shown in FIG. 7A. In this case, only the switch 104 provided at an input terminal of the D-flip-flop 102 of the a-th stage permits an input of SP, and the switches 103 and 104 each provided at input terminals of the first stage to the (a−1)-th stage become in a state of taking in neither outputs of their prior stages nor SP. From the (a+1)-th to the b-th stage, the switches 104 are each in a state of taking in outputs of their prior stages. After the (b+1)-th stage, the switches 104 are each in a state of taking in neither outputs of their prior stages nor SP.

In this state, SP is inputted to the a-th stage, and then sampling pulses are sequentially outputted from the a-th stage up to the b-th stage in accordance with CK and CKb. Then, from the subsequent stage, namely after the (b+1)-th stage, there is no pulse outputted since the switches 104 prohibit inputs from their prior stages.

Once an output of the sampling pulse in the b-th column is complete, the subsequent region is sampled. This time, only the switch 104 provided at an input terminal of the D-flip-flop 102 of the f-th stage permits an input of SP, and the switches 103 and 104 each provided at input terminals of the first stage to the (f−1)-th stage become in a state of taking in neither outputs of their prior stages nor SP. From the (f+1)-th to the g-th stage, the switches 104 are each in a state of taking in outputs of their prior stages. After the (g+1)-th stage, the switches 104 are each in a state of taking in neither outputs of their prior stages nor SP.

In this state, SP is inputted to the f-th stage, and then sampling pulses are sequentially outputted from the f-th stage up to the g-th stage in accordance with CK and CKb. Then, from the subsequent stage, namely after the (g+1)-th stage, there is no pulse outputted since the switches 104 prohibit inputs from their prior stages.

As described above, redundant data does not need to be sampled since a scanning pulse is not outputted in the region where a signal does not have to be updated. That is, as described in Embodiment Mode 1, it becomes possible to scan only a specified region selectively even in the case where a superimpose image overlaps across a plurality of regions.

Described above with reference to FIGS. 7A and 7B is an explanation only on the operation timing of a source side. The same method can be adopted for a gate side by selectively scanning the c-th to d-th rows and the h-th to i-th rows only.

Embodiment Mode 3

Unlike Embodiment Modes 1 and 2, the invention can be also applied to the case where a superimpose image takes an intricate figure.

Figure 12A:
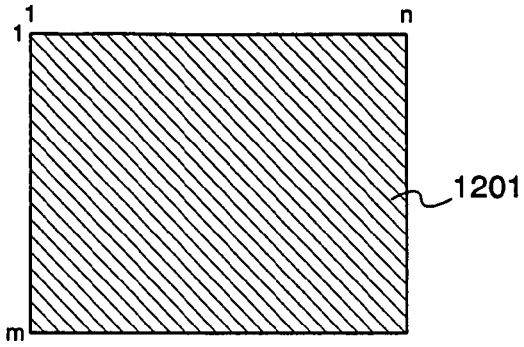
FIGS. 12A to 12C are diagrams for explaining a sampling operation of the invention when a superimpose image is added onto a background image.
Figure 12B:
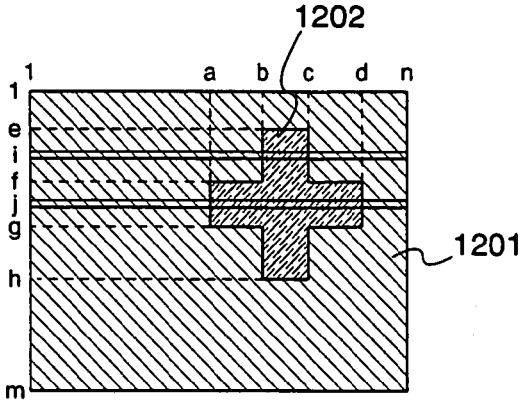
Figure 12C:
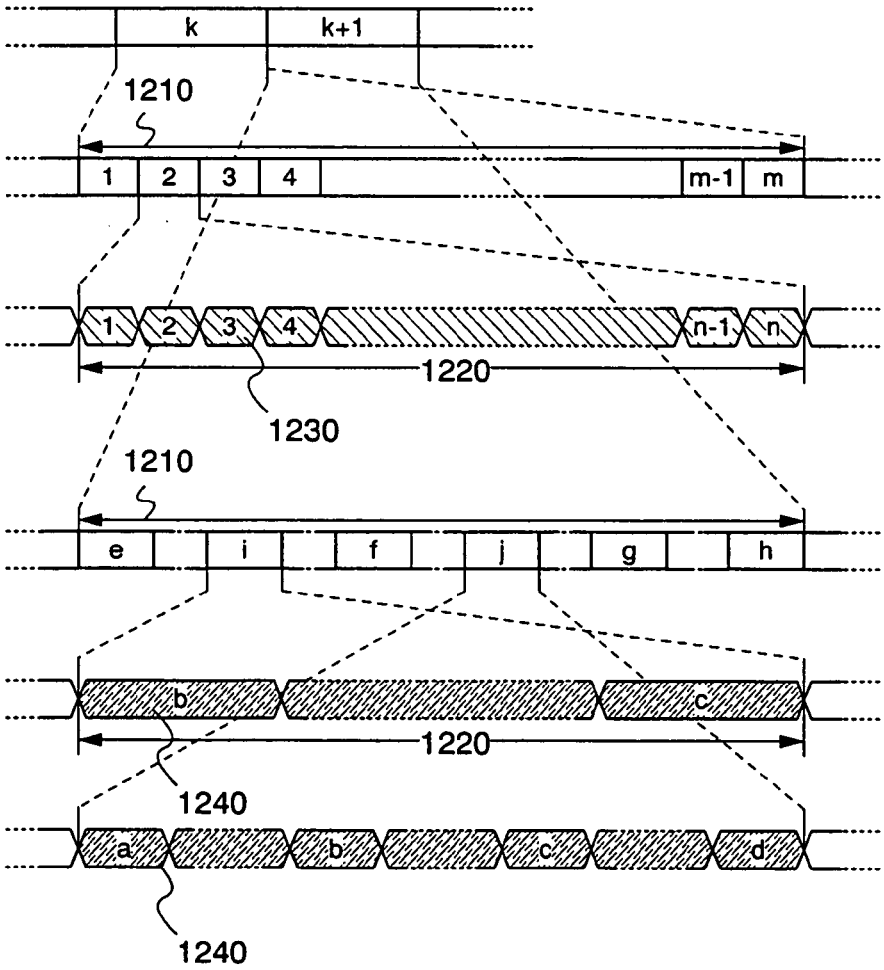

In FIGS. 12A to 12C, an example in the case where a superimpose image takes an intricate figure is shown. As shown in FIGS. 12A and 12B, a superimpose image 1202 is displayed on a background image 1201. At this time, the superimpose image 1202 takes a figure which is surrounded by a region, for example, having (a, f), (b, f), (b, e), (c, e), (c, f), (d, f), (d, g), (c, g), (c, h), (b, h), (b, g), and (a, g) as its tops.

In this case, when the background image 1201 only is displayed at the k-th frame and the superimpose image 1202 is displayed at the (k+1)-th frame, video signals are updated only in the e-th to h-th rows. Therefore, as shown in FIG. 12C, the scanning operation of a gate signal line at the (k+1)-th frame is performed only in the e-th to h-th rows.

Furthermore, in the e-th to f-th rows, the video signals are updated only in the b-th to c-th columns, and likewise in the f-th to g-th rows, updated only in the a-th to b-th columns, and in the g-th to h-th rows, updated only in the b-th to c-th columns.

Accordingly, as shown in FIG. 12C, the sampling operation in the f-th to g-th rows can be performed at a lower operation frequency than usual. Furthermore, the sampling operation in the e-th to f-th rows and in the g-th to h-th rows can be performed at a lower operation frequency than in the f-th to g-th rows.

That is, even when a superimpose image takes an intricate figure, only the region of the superimpose image can be scanned efficiently by controlling the number of samplings (which is the same number as dots whose video signals are updated) at each row.

Embodiment 1

In this embodiment, a display device configured according to the invention and a configuration of a driver circuit for driving the display device are described.

Figure 8:
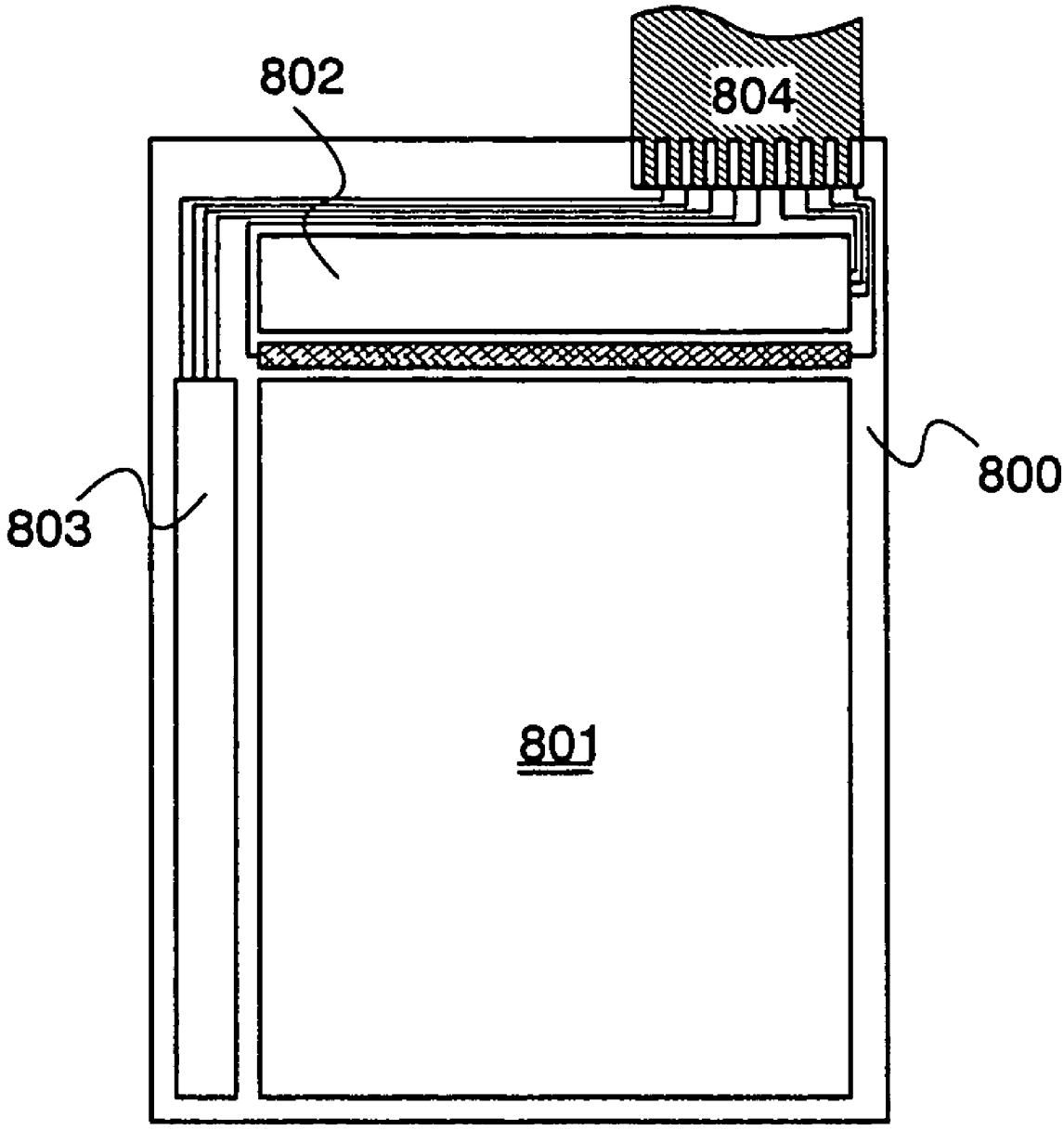
FIG. 8 is a schematic view showing a configuration of a display device.

FIG. 8 shows a schematic view showing a configuration of a display device. It includes a pixel portion 801, a source driver circuit 802 and a gate driver circuit 803 on the periphery of the pixel portion 801, all of which are integrally formed on a substrate 800. Signals and the power are supplied through a Flexible Printed Circuit (FPC) 804 to each driver circuit from an external part.

Figure 9:
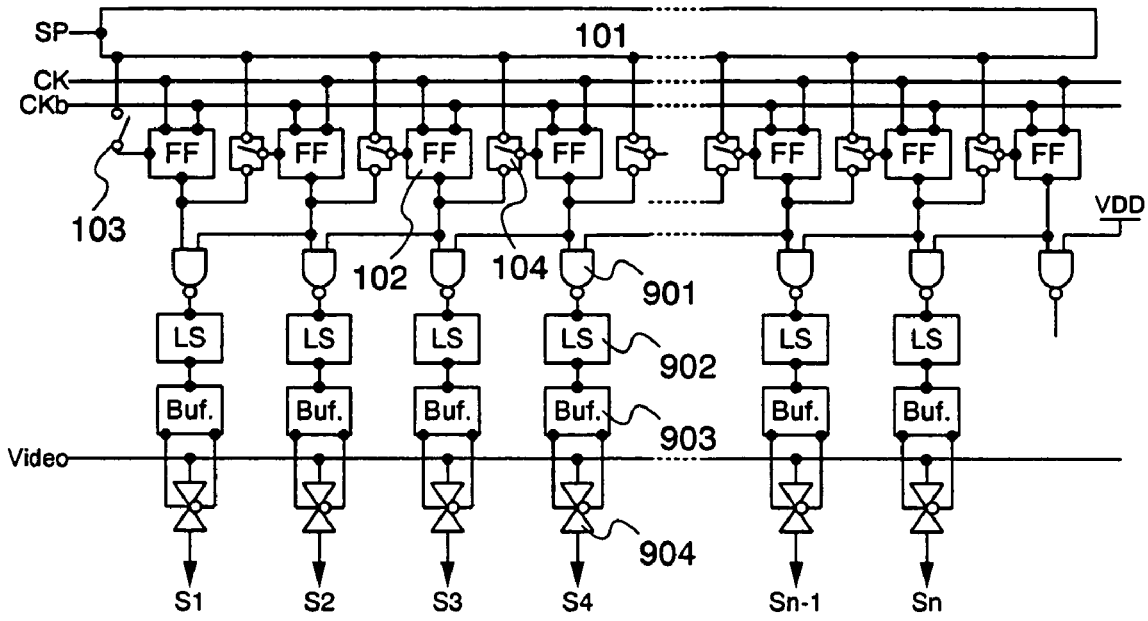
FIG. 9 is a schematic diagram showing a configuration of a source driver circuit.

FIG. 9 shows a configuration example of a source driver circuit for displaying an image by using an analog video signal mainly as a video signal.

The source driver circuit includes a shift register which is composed of a plurality of stages of D-flip-flops 102, a NAND 901, a level shifter 902, a buffer 903, and a sampling switch 904.

Operation thereof is described below. The shift register sequentially outputs sampling pulses according to clock signals (S-CK, S-CKb) and a start pulse (S-SP). The pulses may be outputted sequentially only in an arbitrary region as needed. In the case where two adjacent sampling pulses overlap with each other, the NAND 901 may perform an operation of the adjacent sampling pulses. Depending on the configuration of the shift register, the NAND 901 is not required.

A sampling pulse outputted from the NAND 901 is inputted to the sampling switch 904, through an amplitude conversion by the level shifter 902 and amplification by the buffer 903 if necessary. Each sampling switch 904 takes in inputted analog video signals (Video) in accordance with the timing at which the sampling pulse is inputted, and outputs them to the respective source signal lines $S_1$ to $S_n$ in dot sequence.

Note that, when the shift register or the NAND 901 itself has an enough capability to drive a large load, the level shifter 902 and the buffer 903 may not be necessarily provided.

Figure 10A:
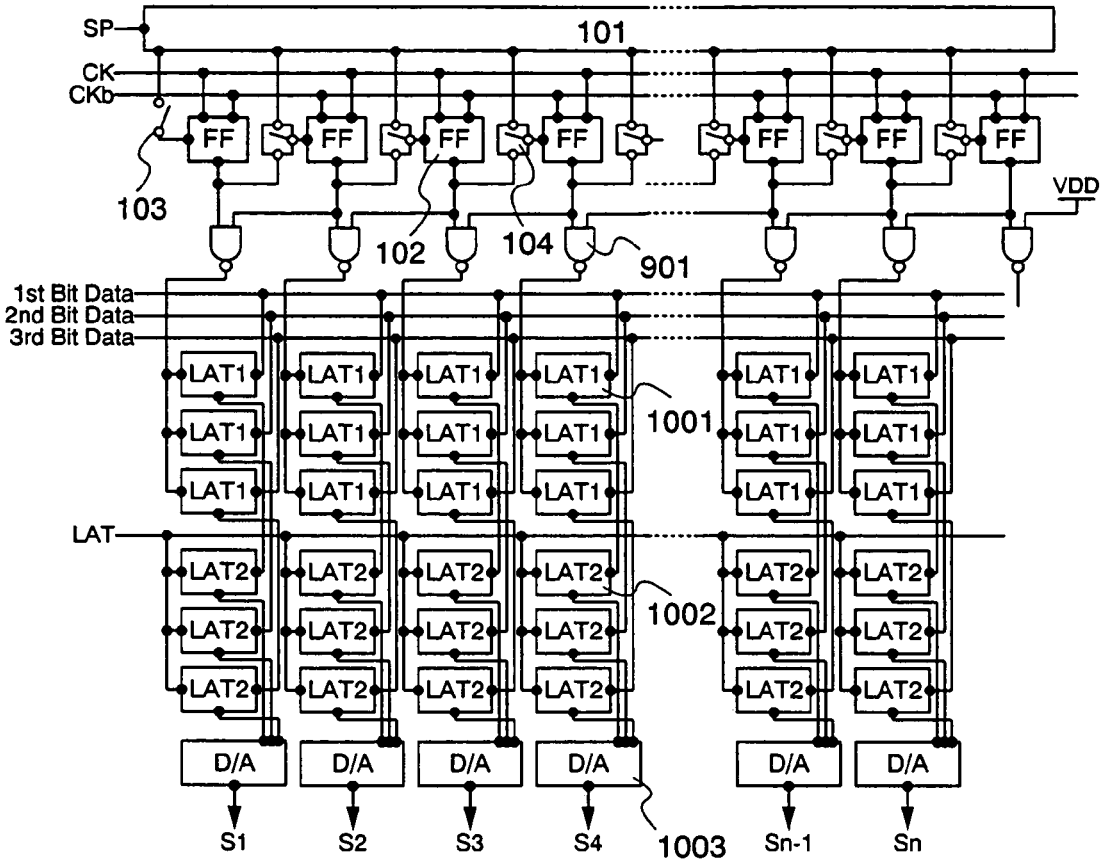
FIGS. 10A and 10B are schematic diagrams showing configurations of a source driver circuit.
Figure 10B:
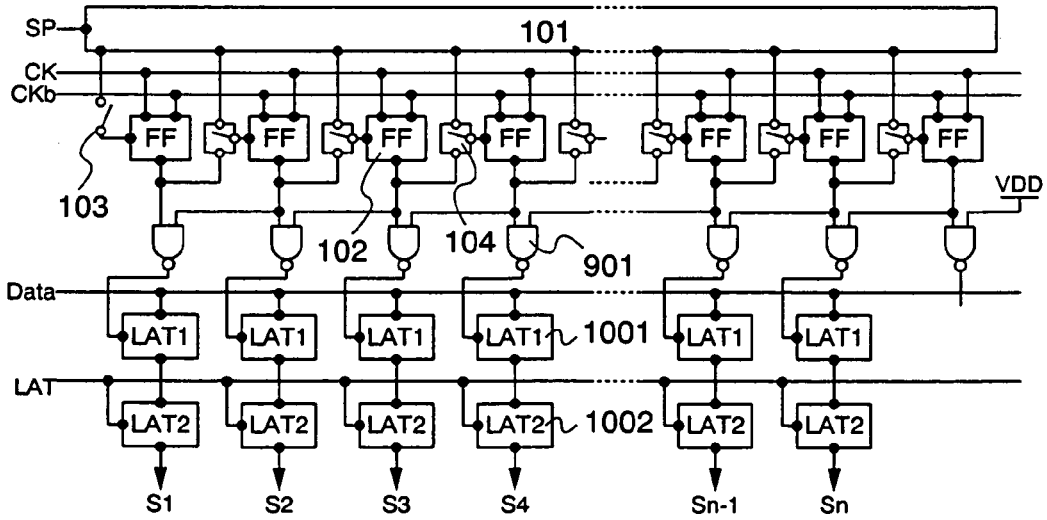

FIGS. 10A and 10B show configuration examples of a source driver circuit for displaying an image by using a digital video signal mainly as a video signal.

In the example of FIG. 10A, the source driver circuit includes a shift register which is composed of a plurality of stages of D-flip-flops 102, a NAND 901, a first latch circuit 1001, a second latch circuit 1002, and a D/A converter circuit 1003.

Operation thereof is described below. The operation from the shift register to the NAND is the same as the one shown in FIG. 9, thus the description is omitted herein.

The first latch circuit 1001 takes in digital video signals (Data) in accordance with the timing at which the sampling pulse is inputted. Here, the first three latch circuits 1001 disposed in parallel take in three bits of the digital video signals simultaneously. The inputted digital video signals are held in the respective first latch circuits 1001.

The operation described above is performed from the first column in sequence. It may be performed sequentially only in an arbitrary region as needed. After the completion of taking in the digital video signals in the first latch circuits 1001 of the last columns, a latch signal (LAT) is inputted. In response to the input of the latch signal, the digital video signals held in the first latch circuits 1001 are transferred to the second latch circuits 1002 all at once. After that, one row of the digital video signals are processed in parallel.

The digital video signals transferred to the second latch circuits 1002 are inputted to the D/A conversion circuits 1003, and undergo a D/A conversion to be converted into analog voltage signals, then the converted signals are outputted to the source signal lines $S_1$ to $S_n$. At this time, signals are not taken in at the first latch circuits 1001 of the stages where no sampling pulse is outputted. Therefore, the outputs of the source signal lines on these stages do not change either.

FIG. 10B shows the configuration example of a source driver circuit for displaying an image by using a digital time gradation method. One first latch circuit 1001 and one second latch circuit 1002 are provided in each column. A digital video signal (Data) is inputted to the first latch circuit 1001 in series from one signal line. An example of the input order is as follows: 1-bit data of a first column 1-bit data of a second column→ . . . →1-bit data of the last column→2-bit data of the first column→2-bit data of the second column→ . . . → 2-bit data of the last column→lower-bit data of the first column→lower-bit data of the second column→ . . . →lower-bit data of the last column. It is to be noted that the order in which digital video signals are inputted is not limited to this. The operation of the respective portions is the same as that shown in FIG. 10A, thus the description is omitted herein.

Figure 11:
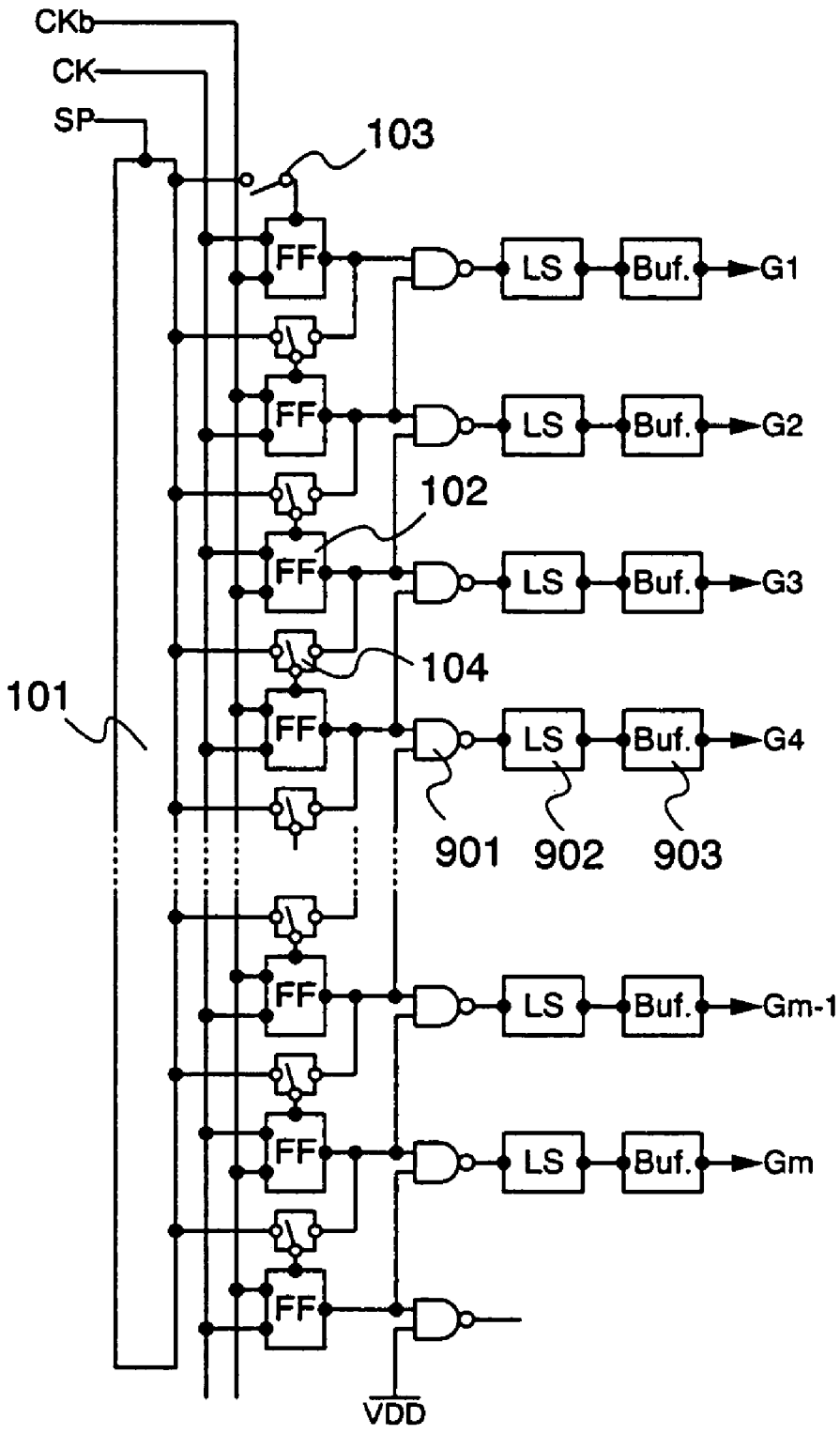
FIG. 11 is a schematic diagram showing a configuration of a gate driver circuit.

FIG. 11 shows a configuration example of a gate driver circuit.

In the example of FIG. 11, the gate driver circuit includes a shift register which is composed of a plurality of stages of D-flip-flops 102, a NAND 901, a level shifter 902, and a buffer 903 just as the source driver circuit. However, the NAND 901, the level shifter 902, and the buffer 903 may be provided only when necessary just as the case of the source driver circuit.

The operation is the same as described in the section of the source driver circuits. Row selection pulses are sequentially outputted from the shift register and the NAND 901 operates the adjacent pulses. After undergoing an amplitude conversion by the level shifter 902, each pulse is outputted to the respective gate signal lines $G_1$ to $G_m$ through the buffer 903 to select the gate signal lines in sequence from the first row. Only a selected region may be selected sequentially from line to line as needed. The gate driver circuit may be used in combination with any of the source driver circuits described above.

Embodiment 2

A display device of the invention has various uses. Electronic apparatuses to which the invention can be applied are described below.

Examples of the electronic apparatuses include portable information terminals (electronic books, mobile computers, mobile telephones, etc.) video cameras, digital cameras, personal computers, television, and the like. Specific examples of these electronic apparatuses are shown in FIG. 13.

Figure 13A:
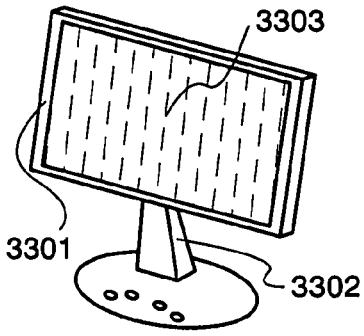
FIGS. 13A to 13F are examples of electronic apparatuses to which the invention can be applied.

FIG. 13A shows an EL display, which includes a frame 3301, a support base 3302, a display portion 3303, and the like. The display device of the invention can be used in the display portion 3303.

Figure 13B:
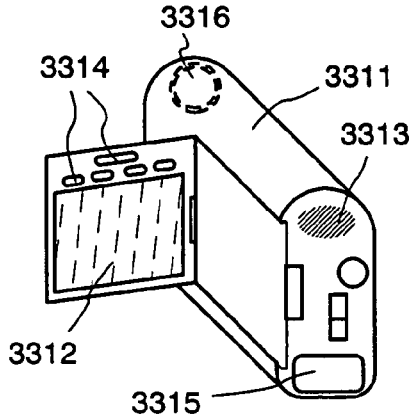

FIG. 13B shows a video camera, which includes a main body 3311, a display portion 3312, an audio input portion 3313, operation switches 3314, a battery 3315, an image-receiving portion 3316, and the like. The display device of the invention can be used in the display portion 3312.

Figure 13C:
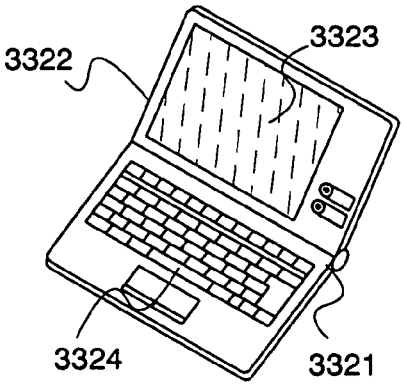

FIG. 13C shows a personal computer, which includes a main body 3321, a frame 3322, a display portion 3323, a keyboard 3324, and the like. The display device of the invention can be used in the display portion 3323.

Figure 13D:
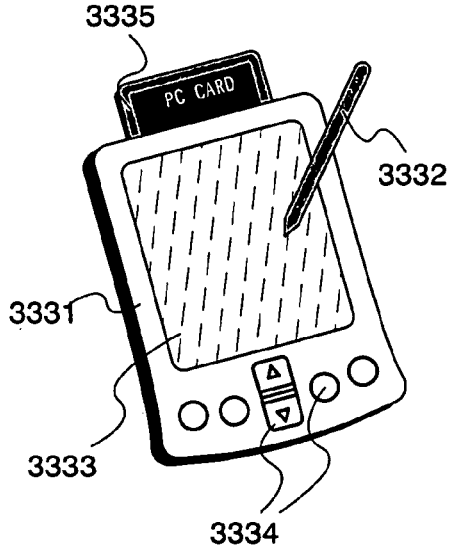

FIG. 13D shows a portable information terminal, which includes a main body 3331, a stylus 3332, a display portion 3333, operation keys 3334, an external interface 3335, and the like. The display device of the invention can be used in the display portion 3333.

Figure 13E:
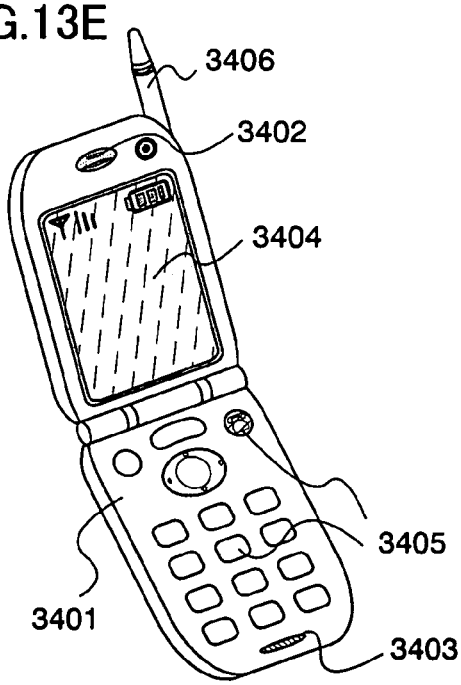

FIG. 13E shows a mobile telephone, which includes a main body 3401 an audio output portion 3402, an audio input portion 3403, a display portion 3404, operation switches 3405, an antenna 3406, and the like. The display device of the present invention can be used in the display portion 3404.

Figure 13F:
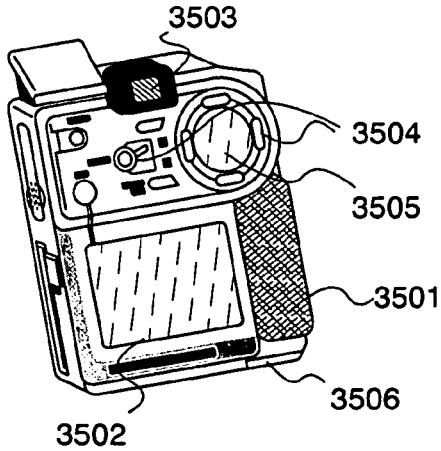

FIG. 13F shows a digital camera, which includes a main body 3501, a display portion (A) 3502, an eyepiece portion 3503, an operation switch 3504, a display portion (B) 3505, a battery 3506, and the like. The display device of the present invention can be used in the display portions (A) 3502 and (B) 3505.

As described above, an application range of the invention is so wide that the invention can be applied to electronic apparatuses in various fields. The electronic apparatuses in this embodiment can be provided in a structure of any combination with the foregoing embodiment modes and embodiments.

What is claimed is:

1. A display device comprising:

a pixel portion where pixels are arranged in matrix of m rows by n columns;

a source driver circuit, wherein the source driver circuit comprises a first scanning circuit which outputs at least n stages of sampling pulses and includes n switches, and wherein the first scanning circuit is configured to operate so that a first operation in which sampling pulses are sequentially outputted from the first stage up to the n-th stage is performed and a second operation in which sampling pulses are sequentially outputted from the a-th (a is a natural number and $1<a\leqq n$) stage up to the b-th (b is a natural number and $a\leqq b\leqq n$) stage is performed;

a gate driver circuit, wherein the gate driver circuit comprises a second scanning circuit which outputs at least m stages of row selection pulses and includes m switches, and wherein the second scanning circuit is configured to operate so that a first operation in which row selection pulses are sequentially outputted from the first stage up to the m-th stage is performed and a second operation in which row selection pulses are sequentially outputted from the c-th (c is a natural number and $1<c\leqq m$) stage up to the d-th (d is a natural number and $c\leqq d\leqq m$) stage is performed, wherein the a-th (a is a natural number and $1<a\leqq n$) switch is provided at an input terminal of the a-th stage and the a-th switch selects an input of a start pulse in the second operation, wherein the c-th (c is a natural number and $1<c\leqq m$) switch is provided at an input terminal of the c-th stage and the c-th switch selects an input of a start pulse in the second operation, wherein an image by the first operation remains at the second operation except from the a-th stage to the b-th stage and from the c-th stage to the d-th stage, and wherein each of the n switches except for a first switch is configured to select an input between a start pulse and an output pulse of the previous stage.

2. An electronic apparatus selected from the group consisting of a portable information terminal, a video camera, a digital camera, a personal computer and a television comprising the display device of claim 1.

3. The display device according to claim 1, wherein the first scanning circuit includes n flip-flops and the second scanning circuit includes m flip-flops.

4. The display device according to claim 1, wherein each of the n switches is connected to a first address decoder and each of the m switches is connected to a second address decoder, wherein the first address decoder selects a stage to which the start pulse is inputted, and wherein the second address decoder selects a stage to which the start pulse is inputted.

5. A display device comprising:

a pixel portion where pixels are arranged in matrix of m rows by n columns;

a source driver circuit, wherein the source driver circuit comprises a first scanning circuit which outputs at least n stages of sampling pulses and includes n switches, and a gate driver circuit, wherein the gate driver circuit comprises a second scanning circuit which outputs at least m stages of row selection pulses and includes m switches, wherein a first switch of n switches is provided at an input terminal of the first stage, and a k-th switch is provided at an input terminal of the k-th (k is a natural number and $1<k\leqq n$) stage, wherein the first switch is configured to select an input to the input terminal of the first stage between a start pulse and no connection, and the k-th switch is configured to select an input to the input terminal of the k-th stage between a start pulse, an output pulse of the (k−1)-th stage and no connection, and wherein each of the n switches except for the first switch is configured to select an input between a start pulse and an output pulse of the previous stage.

6. An electronic apparatus selected from the group consisting of a portable information terminal, a video camera, a digital camera, a personal computer and a television comprising the display device of claim 5.

7. The display device according to claim 5, wherein the first scanning circuit includes n flip-flops, a (k−1)-th flip-flop being provided at the (k−1)-th stage and between the (k−1)-th switch and the k-th switch.

8. The display device according to claim 5, wherein each of the n switches is connected to a first address decoder and each of the m switches is connected to a second address decoder, wherein the first address decoder selects a stage to which the start pulse is inputted, and wherein the second address decoder selects a stage to which the start pulse is inputted.

9. A display device comprising:

a pixel portion where pixels are arranged in matrix of m rows by n columns;

a source driver circuit, wherein the source driver circuit comprises a first scanning circuit which outputs at least n stages of sampling pulses and includes n switches, and a gate driver circuit, wherein the gate driver circuit comprises a second scanning circuit which outputs at least m stages of row selection pulses and includes m switches, wherein a first switch of m switches is provided at an input terminal of the first stage, and a j-th switch is provided at an input terminal of the j-th (j is a natural number and $1<j\leqq m$) stage, wherein the first switch is configured to select an input to the input terminal of the first stage between a start pulse and no connection, and the j-th switch is configured to select an input to the input terminal of the j-th stage between a start pulse, an output pulse of the (j−1)-th stage and no connection, and wherein each of the m switches except for the first switch is configured to select an input between a start pulse and an output pulse of the previous stage.

10. An electronic apparatus selected from the group consisting of a portable information terminal, a video camera, a digital camera, a personal computer and a television comprising the display device of claim 9.

11. The display device according to claim 9, wherein the second scanning circuit includes m flip-flops, a (j−1)-th flip-flop being provided at the (j−1)-th stage and between the (j−1)-th switch and the j-th switch.

12. The display device according to claim 9, wherein each of the n switches is connected to a first address decoder and each of the m switches is connected to a second address decoder, wherein the first address decoder selects a stage to which the start pulse is inputted, and wherein the second address decoder selects a stage to which the start pulse is inputted.

13. A mobile telephone comprising:

a main body;

a display portion;

operation switches; and an antenna, wherein the display portion comprises:

a pixel portion where pixels are arranged in matrix of m rows by n columns;

a source driver circuit, wherein the source driver circuit comprises a first scanning circuit which outputs at least n stages of sampling pulses and includes n switches, and wherein the first scanning circuit is configured to operate so that a first operation in which sampling pulses are sequentially outputted from the first stage up to the n-th stage is performed and a second operation in which sampling pulses are sequentially outputted from the a-th (a is a natural number and $1<a\leqq n$) stage up to-the b-th (b is a natural number and $a\leqq b\leqq n$) stage is performed;

a gate driver circuit, wherein the gate driver circuit comprises a second scanning circuit which outputs at least m stages of row selection pulses and includes m switches, and wherein the second scanning circuit is configured to operate so that a first operation in which row selection pulses are sequentially outputted from the first stage up to the m-th stage is performed and a second operation in which row selection pulses are sequentially outputted from the c-th (c is a natural number and $1<c\leqq m$) stage up to the d-th (d is a natural number and $c\leqq d\leqq m$) stage is performed, wherein the a-th (a is a natural number and $1<a\leqq n$) switch is provided at an input terminal of the a-th stage and the a-th switch selects an input of a start pulse in the second operation, wherein the c-th (c is a natural number and $1<c\leqq m$) switch is provided at an input terminal of the c-th stage and the c-th switch selects an input of a start pulse in the second operation, and wherein an image by the first operation remains at the second operation except from the a-th stage to the b-th stage and from the c-th stage to the d-th stage, and wherein each of the n switches except for a first switch is configured to select an input between a start pulse and an output pulse of the previous stage.

14. The mobile telephone according to claim 13, wherein the first scanning circuit includes n flip-flops and the second scanning circuit includes m flip-flops.

15. The mobile telephone according to claim 13, wherein each of the n switches is connected to a first address decoder and each of the m switches is connected to a second address decoder, wherein the first address decoder selects a stage to which the start pulse is inputted, and wherein the second address decoder selects a stage to which the start pulse is inputted.

16. A mobile telephone comprising:

a main body;

a display portion;

operation switches; and an antenna, wherein the display portion comprises:

a pixel portion where pixels are arranged in matrix of m rows by n columns;

a source driver circuit, wherein the source driver circuit comprises a first scanning circuit which outputs at least n stages of sampling pulses and includes n switches; and a gate driver circuit, wherein the gate driver circuit comprises a second scanning circuit which outputs at least m stages of row selection pulses and includes m switches, wherein a first switch of n switches is provided at an input terminal of the first stage, and a k-th switch is provided at an input terminal of the k-th (k is a natural number and $1<k\leqq n$) stage, wherein the first switch is configured to select an input to the input terminal of the first stage between a start pulse and no connection, and the k-th switch is configured to select an input to the input terminal of the k-th stage between a start pulse, an output pulse of the (k−1)-th stage and no connection, and wherein each of the n switches except for the first switch is configured to select an input between a start pulse and an output pulse of the previous stage.

17. The mobile telephone according to claim 16, wherein the first scanning circuit includes n flip-flops, a (k−1)-th flip-flop being provided at the (k−1)-th stage and between the (k−1)-th switch and the k-th switch.

18. The mobile telephone according to claim 16, wherein each of the n switches is connected to a first address decoder and each of the m switches is connected to a second address decoder, wherein the first address decoder selects a stage to which the start pulse is inputted, and wherein the second address decoder selects a stage to which the start pulse is inputted.

19. A mobile telephone comprising:

a main body;

a display portion;

operation switches; and an antenna, wherein the display portion comprises:

a pixel portion where pixels are arranged in matrix of m rows by n columns;

a source driver circuit, wherein the source driver circuit comprises a first scanning circuit which outputs at least n stages of sampling pulses and includes n switches; and a gate driver circuit, wherein the gate driver circuit comprises a second scanning circuit which outputs at least m stages of row selection pulses and includes m switches, wherein a first switch of m switches is provided at an input terminal of the first stage, and a j-th switch is provided at an input terminal of the j-th (j is a natural number and $1<j\leqq m$) stage, wherein the first switch is configured to select an input to the input terminal of the first stage between a start pulse and no connection, and the j-th switch is configured to select an input to the input terminal of the j-th stage between a start pulse, an output pulse of the (j−1)-th stage and no connection, and wherein each of the n switches except for the first switch is configured to select an input between a start pulse and an output pulse of the previous stage.

20. The mobile telephone according to claim 19, wherein the second scanning circuit includes m flip-flops, a (j−1)-th flip-flop being provided at the (j−1)-th stage and between the (j−1)-th switch and the j-th switch.

21. The mobile telephone according to claim 19, wherein each of the n switches is connected to a first address decoder and each of the m switches is connected to a second address decoder, wherein the first address decoder selects a stage to which the start pulse is inputted, and wherein the second address decoder selects a stage to which the start pulse is inputted.

* * * * *